US009625236B2

(12) United States Patent
Wållberg

(10) Patent No.: US 9,625,236 B2
(45) Date of Patent: Apr. 18, 2017

(54) METHOD OF FIRE CONTROL FOR GUN-BASED ANTI-AIRCRAFT DEFENCE

(71) Applicant: BAE SYSTEMS BOFORS AB, Karlskoga (SE)

(72) Inventor: Kjell Wållberg, Degerfors (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 14/894,607

(22) PCT Filed: May 7, 2014

(86) PCT No.: PCT/SE2014/000057
§ 371 (c)(1),
(2) Date: Nov. 30, 2015

(87) PCT Pub. No.: WO2014/193284
PCT Pub. Date: Dec. 4, 2014

(65) Prior Publication Data

US 2016/0131455 A1 May 12, 2016

(30) Foreign Application Priority Data

May 28, 2013 (SE) ..... 1330063

(51) Int. Cl.
*G06F 19/00* (2011.01)
*F41G 5/08* (2006.01)
(Continued)

(52) U.S. Cl.
CPC ..... *F41G 5/08* (2013.01); *F41G 3/02* (2013.01); *F41G 3/04* (2013.01); *F41G 3/14* (2013.01)

(58) Field of Classification Search
CPC ..... F41G 3/02; F41G 3/04; F41G 3/14; F41G 5/08
(Continued)

(56) References Cited

U.S. PATENT DOCUMENTS 3,339,457 A 9/1967 Pun
4,402,251 A 9/1983 Burke et al.
(Continued)

FOREIGN PATENT DOCUMENTS

EP 0527715 A1 2/1993
EP 1610152 A1 12/2005
(Continued)

OTHER PUBLICATIONS

PCT/ISA/210—International Search Report—Oct. 29, 2014 (Issued in Application No. PCT/SE2014/000057).
(Continued)

*Primary Examiner* — Seung Lee
(74) *Attorney, Agent, or Firm* — Venable, LLP; Jeffri Kaminski

(57) ABSTRACT

A method of fire control against aerial targets traveling towards an object of protection. A position of the object of protection is known. A position of the aerial target is measured. The position of the aerial target is estimated. A velocity of the aerial target is estimated. A model of a guidance law of the aerial target is applied. An acceleration of the aerial target sufficient to hit the object of protection is calculated. A future trajectory of the aerial target is predicted based on the position of the object of protection, the estimated position of the aerial target, the estimated velocity of the aerial target, and the calculated acceleration of the aerial target. Points of aim along the predicted future trajectory are
(Continued)

calculated. A fire control system includes at least one sensor for measuring the position of the aerial target as a function of time.

5 Claims, 3 Drawing Sheets

(51) Int. Cl.
*F41G 3/04* (2006.01)
*F41G 3/02* (2006.01)
*F41G 3/14* (2006.01)

(58) Field of Classification Search
USPC ..... 235/400, 404, 411–413
See application file for complete search history.

(56) References Cited

U.S. PATENT DOCUMENTS

| | | | | |
|---|---|---|---|---|
| 4,622,554 | A | 11/1986 | Gellekink et al. | |
| 5,051,751 | A | 9/1991 | Gray | |
| 7,394,046 | B2 * | 7/2008 | Olsson | G01S 11/04 244/3.1 |
| 8,106,340 | B1 * | 1/2012 | Diaz | F41G 7/008 244/3.1 |
| 8,173,946 | B1 * | 5/2012 | Patterson | F41F 3/073 244/3.1 |
| 8,314,733 | B1 * | 11/2012 | Malakian | G01S 13/582 342/104 |
| 8,963,765 | B1 * | 2/2015 | Pedersen | G01S 13/72 235/400 |

FOREIGN PATENT DOCUMENTS

| | | | |
|---|---|---|---|
| GB | 2107834 | A | 5/1983 |
| WO | WO-9939150 | A1 | 8/1999 |

OTHER PUBLICATIONS

PCT/ISA/237—Written Opinion of the International Search Authority—Oct. 29, 2014 Issued in Application No. PCT/SE2014/000057).

Phalanx CIWS, Wikipedia, Apr. 26, 2013, retrieved from the internet: http://web.archive.org/web/20130428165038/http://en.wikipedia.org/wiki/Phalanx_CIWS; whole document; Oct. 22, 2015.

Typical antiaircraft fire control systems, Historical Naval Ships Association, 2007, retrieved from the internet: http://www.hnsa.org/doc/firecontrol/partg.htm; whole document; Oct. 1, 2014.

Dyer W.R., Modern missile analysis, Riva, Maryland: Applied Technology Institute, 2004, retrieved from the internet: http://www.aticourses.com/sampler/Modern_Missile_Analysis.pdf; pp. 18-22; Sep. 30, 2014.

Phalanx CIWS, Wikipedia, Apr. 26, 2013, retrieved from the internet: http://web.archive.org/web/20130428165038/http://en.wikipedia.org/wiki/Phalanx_CIWS; whole document; Oct. 22, 2014.

Typical antiaircraft fire control systems, Historica Naval Ships Association, 2007, retrieved from the internet: http://www.hnsa.org/doc/firecontrol/partg.htm; whole document; Oct. 1, 2014.

Dyer W.R., Modern missile analysis, Riva, Maryland: Applied Technology Institute, 2004, retrieved from the internet: http://www.aticourses.com/sampler/Modern_Missile_Analysis.pdf; pp. 18-35; Sep. 30, 2014.

Supplementary European Search Report mailed Nov. 22, 2016 in corresponding EP Application No. 14 80 4407.

* cited by examiner

METHOD OF FIRE CONTROL FOR GUN-BASED ANTI-AIRCRAFT DEFENCE

CROSS-REFERENCE TO RELATED APPLICATIONS

This application claims priority to Swedish patent application 1330063-7 filed 28 May 2013 and is the national phase under 35 U.S.C. §371 of PCT/SE2014/000057 filed 7 May 2014.

FIELD OF THE INVENTION

The present application relates to a method to be employed by gun-based anti-aircraft defence that is to use unguided munitions to defend objects of protection in known positions against attacks by guided airborne weapon craft. The method shows a way of predicting the future positions of the attacking craft.

BACKGROUND OF THE INVENTION, PROBLEM APPROACH AND PRIOR ART

When fighting a moving aerial target using unguided projectiles fired from guns, the projectiles must be fired at the points where the aerial target will be located when the projectiles hit. Such points, normally called points of aim, must be predicted. A prediction, in this context, is an approximation of the aerial target's position a short time into the future. The approximation is based on knowledge of the aerial target's previous positions and a hypothesis of how the aerial target will behave in the future.

An approximation of the aerial target's current position and motion status based on a continuous data flow from an ongoing measurement of the aerial target's position is called an estimation of target data.

Estimation and prediction take place in parallel, at least until a fight sequence starts. At least one sensor is used to track and measure the aerial target's position. Based on measurement data from this sensor, the aerial target's current position and velocity are estimated. A predictor then calculates, based on estimate and hypothesis, how the firing weapons should be aimed.

Examples of the method and apparatus for fire control against aircraft are provided in patent document EP0527715 A1. There, the proposed prediction hypothesis is that an aircraft's trajectory can be described using one of a number of simple geometric models. No account is taken of the fact that the trajectory of an attacking, guided airborne weapon craft is a consequence of the guidance law applied by the airborne weapon craft to reach its target: in this case, hitting one of the objects of protection that the gun-based anti-aircraft defence is intended to defend.

The problem of currently existing solutions according to the above-mentioned document is thus that an attacking airborne weapon craft steering towards its target will, in general, not travel along a trajectory that can be described by a simple geometric model. Points of aim predicted based on an incorrect hypothesis regarding the future path of the aerial target will, of course, also be incorrect.

Further problems meant to be solved by the present invention will become apparent in connection with the following detailed description of the various embodiments.

PURPOSE OF THE INVENTION AND ITS DISTINCTIVE FEATURES

The purpose of the present invention is to improve the possibility to calculate correct points of aim when gun-based anti-aircraft defence is used to defend objects of protection with known positions against attacking guided airborne weapon craft. The purpose is achieved by calculating the trajectories that an attacking craft may follow. The calculation is based on known data of the positions of the objects of protection, estimated knowledge of the craft's current position and velocity, as well as knowledge and/or an assumption of the guidance laws that an attacking craft may apply to hit any of the objects of protection in question. Thus, when predicting the future position of a craft, hypotheses about the guidance law that gives rise to the trajectory of the craft are used—as opposed to applying a hypothesis about the geometric shape of the trajectory.

The invention relates to a method of fire control against aerial targets on their way towards an object of protection where the position of the object of protection is known, comprising the following method steps:

measuring the position of the aerial target,
estimating the position of the aerial target,
estimating the velocity of the aerial target,
applying a model of the aerial target's guidance law,
calculating the accelerations the aerial target must apply in order to hit the object of protection,
predicting the future trajectory of the aerial target based on the position of the object of protection, the estimated position of the aerial target, the estimated velocity of the aerial target, the calculated acceleration of the aerial target,
calculating points of aim along the predicted trajectory.

According to further aspects of the method of fire control against aerial targets heading for an object of protection, the following applies:

that the guidance law of the aerial target comprises navigation constants calculated by multiplying the observed acceleration by the predicted time to impact into the object of protection squared, divided by the distance from the aerial target to the object of protection.

that the guidance law of the aerial target comprises a maximum acceleration, the size of which is estimated by an analysis of the observed accelerations of the aerial target.

that the position of the object of protection is the same as that of a gun-based anti-aircraft defence.

Furthermore, the invention consists of a fire control system for fire control against aerial targets comprising at least one sensor for measuring the position of the aerial target as a function of time applying the method of fire control against aerial targets heading for an object of protection where the position of the object of protection is known, comprising the following method steps:

measuring the position of the aerial target,
estimating the position of the aerial target,
estimating the velocity of the aerial target,
applying a model of the aerial target's guidance law,
calculating the accelerations the aerial target must apply in order to hit the object of protection,
predicting the future trajectory of the aerial target based on the position of the object of protection, the estimated position of the aerial target, the estimated velocity of the aerial target, the calculated acceleration of the aerial target,
calculating points of aim along the predicted trajectory.

According to further aspects of a fire control system for fire control against aerial targets, the following applies:

that the guidance law of the aerial target comprises navigation constants calculated by multiplying the observed acceleration by the predicted time to impact into the object of protection squared, divided by the distance from the aerial target to the object of protection.

that the guidance law of the aerial target comprises a maximum acceleration, the size of which is estimated by an analysis of the observed accelerations of the aerial target.

that the position of the object of protection is the same as that of a gun-based anti-aircraft defence.

BENEFITS AND EFFECTS OF THE INVENTION

The advantage of the present invention is that the points of aim calculated makes it possible to aim guns so that the projectiles, preferably unguided, which are fired at the time of firing, get close enough to the attacking craft for impact to be achieved.

LIST OF DRAWINGS

In the following, the invention will be described with reference to the accompanying drawings in which.

DETAILED DESCRIPTION OF EMBODIMENTS

An attacking guided airborne craft, also called an aerial target, is intended to harm a target of attack or an object of protection, depending on the perspective from which the target of attack or object of protection is viewed. Fighting the aerial target means that the aerial target is affected so that it can no longer harm the object of protection towards which the aerial target travels.

A system designed to fight aerial targets using guns and unguided projectiles can be regarded as consisting of three parts: fire control, weapons and projectiles. In the following, such a system will be referred to as gun-based anti-aircraft defence. Unguided projectiles are to be understood as various forms of projectiles such as shells and rockets intended to fight aerial targets.

Fire control being part of a gun-based anti-aircraft defence includes one or more sensors and a plurality of methods to manage and evaluate sensor data. In the following, the sensor(s) included in, and used by, the fire control will be referred to as sight.

Refined information from the sight is used to control the orientation of both sight and weapons.

Fighting can be regarded as consisting of a number of activities. Some activities must take place in sequence while others can take place in parallel.

Figure 1:
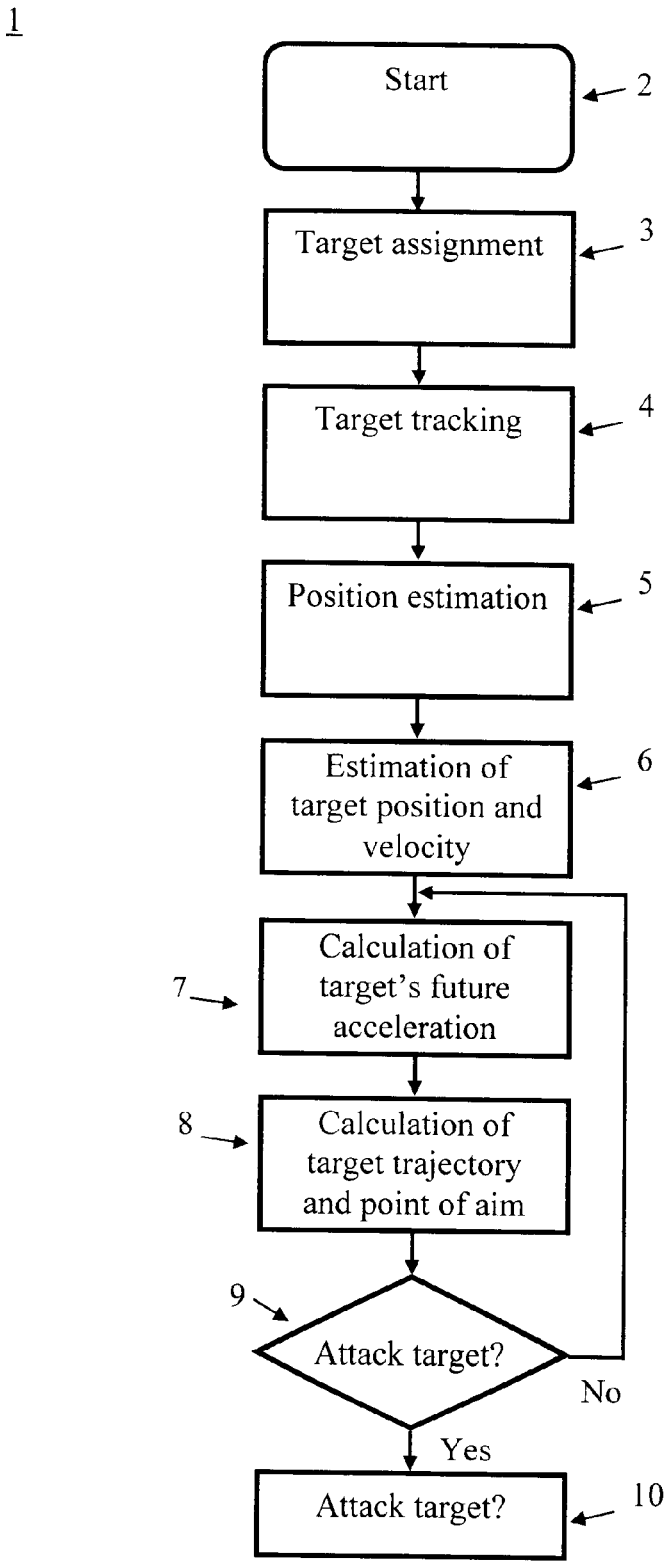
FIG. 1 shows a flowchart of the method of fire control against aerial targets according to an embodiment of the invention.

FIG. 1 describes a flowchart of a method of a fire control system 1. As fighting is initiated, Start 2 in FIG. 1, the sight is directed towards the aerial target to be fought. Usually, this is made possible by an external device, such as a reconnaissance radar, continuously delivering information on the position of the aerial target as a function of time. This external device is called the assigning device. This procedure is called target assignment 3.

The position of the aerial target is then specified in an orthonormalised, levelled, north-oriented, Cartesian coordinate system the origin of which is known to all the gun-based anti-aircraft defence systems making up the air defence on the site.

In parallel with the sight being directed towards the aerial target, the gun barrel can be oriented towards a tentatively calculated point of aim the position of which is based on data from the assigning device. Thereby, the time for barrel orientation is reduced when a more precise point of aim has been calculated, because the tentatively calculated point of aim will be close to the more precisely, later, calculated point of aim.

Completed target assignment means that the sight itself may be able to measure the position of the aerial target. However, it is not certain that the sight can immediately detect the aerial target—despite the fact that it is correctly oriented.

Given that the aerial target is approaching, the likelihood increases that the sight will be able to detect the aerial target. The course of events occurring when this happens is called target acquisition.

Target acquisition marks the beginning of a new sequence called target tracking 4. The sight then controls its own line of sight so that the line of sight follows the aerial target.

When target tracking 4 has been established, position estimation 5 starts. The sight now attempts to measure both direction and distance to the aerial target. It cannot be assured that the sight can measure the distance to the aerial target immediately when position estimation 5 is initiated. Sooner or later, however, the sight will begin delivering distance data. Meanwhile, the position of the aerial target and the preliminary point of aim can be calculated by combining angular data from the sight and distance data from the assigning device.

When the sight can eventually generate both direction data and distance data, target assignment data is no longer needed to guide the sight and barrel. However, target assignment data can be used for other purposes.

When the sight estimates the position of the aerial target, during position estimation 5, that is normally done with higher frequency and with better accuracy than can be done by the assigning sensor. This is the basic reason why two types of sensors are used, reconnaissance sensors and fire control sensors.

Raw data from a sight has the form of spherical spatial coordinates, i.e., two angles and a distance. Furthermore, these data are marked with the point in time when the spatial coordinates were valid. Raw data from the sight are used as follows: Measurement data are transformed into a levelled, north-oriented, Cartesian coordinate system, thereby obtaining the form of three Cartesian spatial coordinates and a point in time indicating when the coordinates were valid. The spatial coordinates are denoted x, y, z, and the point in time when the coordinates were valid is denoted t. Each set of measurement data is thus composed of four scalar values (x, y, z, t). The weapon to be used later knows its own position and orientation in the coordinate system used by the sight. Furthermore, sight and weapon use a common time.

The fire control stores measurement data of an age not exceeding a certain value, for example in the order of three seconds, in a buffer. When the buffer is full and a new set of measurement data is recorded, the measurement data with the oldest validity time are deleted.

To measurement data of an age not exceeding a variable value, for example, in the order of one second, coefficients of three polynomials are adjusted. These polynomials together describe the position of the aerial target as a function of time. The degree values of the polynomials must be chosen based on the raw data. In the following example, polynomials of degree 2 have been selected:

$$x(t)=p_{0x}+v_{0x}t+a_{0x}t^2/2$$

$$y(t)=p_{0y}+v_{0y}t+a_{0y}t^2/2$$

$$z(t)=p_{0z}+v_{0z}t+a_{0z}t^2/2$$

The time interval from which the raw data were retrieved for the polynomial adjustment is referred to below as the time window. The adjustment of the polynomial coefficients, i.e., the vectors $p_0$, $v_0$ and $a_0$, to these measurement data can, for example, be performed using the least-squares method. Also other methods or techniques to adjust the measurement data can be used. Before adjustment of the measurement data, data too aberrant (so-called outliers) can be removed from the time window.

When the polynomial coefficients have been calculated, the polynomials can be used to calculate the estimated position of the aerial target at a certain point in time.

The polynomials can be differentiated once, which can be used correspondingly to estimate the velocity of the aerial target at a certain point in time.

$$v_x(t)=v_{0x}+a_{0x}t$$

$$v_y(t)=v_{0y}+a_{0y}t$$

$$v_z(t)=v_{0z}+a_{0z}t$$

An additional differentiation yields an estimate of the (in this case constant) acceleration of the aerial target.

$$a_x(t)=a_{0x}$$

$$a_y(t)=a_{0y}$$

$$a_z(t)=a_{0z}$$

The polynomials should not be used to estimate the position, velocity or acceleration at times outside the time window used to calculate the polynomial coefficients. A necessary exception is the time elapsed when waiting for the next set of raw data delivered from the sight. During this time, it is reasonable to use the polynomials to calculate the current position and velocity. Once a new set of raw data arrives from the sight, however, the procedure is repeated and new polynomial coefficients are obtained.

By applying the above procedure every time new data become available, an observation or calculation of the acceleration undertaken by the aerial target can take place. Depending on how the aerial target behaves, such observations can be used in some cases to estimate the maximum acceleration capability of the aerial target.

The duration of the time window used is adapted dynamically. If the measurement precision is low, the measurement data contains noise; then a prolonged window containing several data points is preferred. If the aerial target manoeuvres sharply, thus rapidly changing its state of motion, a shorter window is preferred. Based on the information contained in the raw data, an appropriate window length for any given situation can be calculated dynamically and adaptively.

Similarly the polynomial degree values are adjusted dynamically. In cases where the measurement precision is high and the aerial target does not manoeuvre substantially, degree 2 to 3 can be used. Under opposite conditions, with lower measurement precision and a fast-manoeuvring aerial target, degree 1 may be a better choice. In the latter case, of course, no information on the acceleration of the aerial target is obtained—only the position and average velocity of the aerial target.

It is generally fully possible to work with several processes more or less simultaneously. The processes can use polynomials of different degrees and time windows of different duration.

Regardless of the way output data from the above-described processes are analysed, the result is some form of mathematical model describing the previous position, velocity and acceleration of the aerial target as a function of time.

This far, the processing and assessment of the raw data do not differ from what may be considered normal for fire control designed for the purpose in question. It is when extracted data are used to predict the point of aim towards which the fire should be aimed that the present invention exhibits distinctive features compared to previously known types of fire control.

By far the most common prediction hypothesis is that the aerial target will continue its trajectory from the current position at its current velocity without any acceleration. In that case, the aerial target will travel along a trajectory which is a straight line at constant speed (speed meaning the value of the velocity). The point of aim is the point on the line characterised by the aerial target and a fired projectile needing exactly the same amount of time to reach it. The point of aim, thus, is the only point where the aerial target can be fought.

Another prediction hypothesis is that the aerial target will continue from its current position at its current velocity and its current acceleration (which is assumed to be constant in amount but locked in direction relative to the body-fixed coordinate system of the aerial target). If so, the aerial target will travel along a trajectory the shape of which is determined by the direction of the acceleration in relation to the body-fixed coordinate system of the aerial target, and how this coordinate system rotates. Aside from the fact that the trajectory may now be curved and the speed of the aerial target is no longer necessarily constant, the same applies as above regarding the position of the point of aim.

The problem with these prediction hypotheses is that no account is taken of where the aerial target is probably heading. If the gun-based anti-aircraft defence has been assigned to defend a ship against an attacking anti-ship missile, it is very likely that the anti-ship missile is guided in a way that makes it hit the target of the anti-ship missile, namely the ship, also called the object of protection. By instead using this knowledge of the position of the object of protection, the trajectory of the aerial target can be predicted with greater accuracy.

The aerial target's current position and velocity can be estimated from the raw data, for example, in the way already described. The future acceleration of the aerial target can then be predicted, Calculation of target's future acceleration 7 in FIG. 1, by assuming:

1) that the robot pilot of the aerial target is steering with the intention of hitting the object of protection; and
2) that the robot pilot of the aerial target uses a guidance law that allows it to be modelled, such as by the guidance law known by the name of ZEM (Zero Effort Miss).

If the robot pilot of the attacking craft, i.e., the aerial target, uses ZEM, the robot pilot calculates accelerations as follows:

At every moment, a calculation is made of the miss distance that would arise if no accelerations are applied. Let $s_x$ denote the distance to the point where the object of protection will be passed. Let $s_y$ and $s_z$ denote the distances to the target of attack horizontally and vertically, respectively, when $s_x=0$. The vector ($s_x$, $s_y$, $s_z$), which apparently points out the target of attack, the object of protection, as seen from the attacking craft, the aerial target, is simply the coordinates of the object of protection in the coordinate system of the attacking craft.

Now let v denote the aerial target's speed and let ttg (time to go) denote the time remaining before the object of protection will be passed. ttg (in every moment) is given by:

$$ttg=s_x/v$$

The accelerations the aerial target must apply to hit the object of protection is given by:

$$a_y=-C\ s_y/ttg^2$$

$$a_z=-C\ s_z/ttg^2$$

C is a navigation constant which must be greater than 2. Normally a value between 3 and 7 is used.

The fire control can predict the aerial target's accelerations by acting in exactly the same way as the robot pilot of the aerial target. Thereafter, a point of aim can be predicted in the step Calculation of target trajectory and point of aim 8.

The vector pointing out our object of protection, as seen from the aerial target ($s_x$, $s_y$, $s_z$), can be calculated by transforming the coordinates of the object of protection into the coordinate system of the aerial target.

Such a transformation requires knowledge of both the position and the orientation of the coordinate system of the aerial target. Position and velocity can be estimated directly from measurement data. The coordinate system of the aerial target has its origin in the estimated target position.

How the coordinate system of the aerial target is oriented is given by the estimated velocity of the aerial target. The x-axis is parallel to the velocity vector of the air target, the y-axis is always horizontal and the z-axis is orthogonal to the other two axes.

The coordinates of the object of protection transformed into the coordinate system of the aerial target thus provide the position of the object of protection in the aerial target's coordinate system. Using these data as a basis, the acceleration that the robot pilot of the aerial target will want to apply can be calculated. However, the calculation must be done with the following assumptions:

1) ZEM is good enough as an approximate model for the guidance law actually used by the craft, the aerial target; and
2) the robot pilot uses a certain navigation constant, e.g., C=5.

The thus calculated acceleration is transformed back into the ground-fixed coordinate system. It is used to calculate the point of aim in the step Calculation of the target trajectory and point of aim 8. The calculation is iterative. The position and velocity of the aerial target a small time step (dt) forward in time are calculated. Meanwhile a calculation is made of the amount of time needed by a fired projectile to reach the position where the aerial target has arrived. Subsequently the time is incremented a time step, the new position and velocity of the aerial target are calculated and the time needed by a fired projectile to reach the aerial target is recalculated. The whole process is repeated over and over again for times further and further into the future. When the difference between the time needed by a fired projectile to reach the target, the so-called shooting time, and the sum of all time steps (dt) incremented is less than a certain acceptable error, the point of aim has been found.

When the point of aim is calculated a choice can be made as to whether or not to fight the aerial target in the step Attack target? 9. If this happens, an attack of the target is carried out, in step Attack target 10, preferably using barrel guns.

It is now neither necessary nor desirable to always open fire as soon as possible. On the contrary, it may be an advantage to wait and check if the aerial target really passes through predicted points of aim at predicted points in time. The reason is that it is fully possible to simultaneously predict more than one target trajectory. It is therefore achievable, entirely according to the above description, to predict a number of different trajectories for a number of navigation constants (such as 3, 4, 5, 6, 7) and then compare the predicted trajectories with the trajectory actually observed. That way it can be determined which navigation constant the aerial target seems to use, thus making it known which of the predicted target trajectories is most correct.

Figure 2:
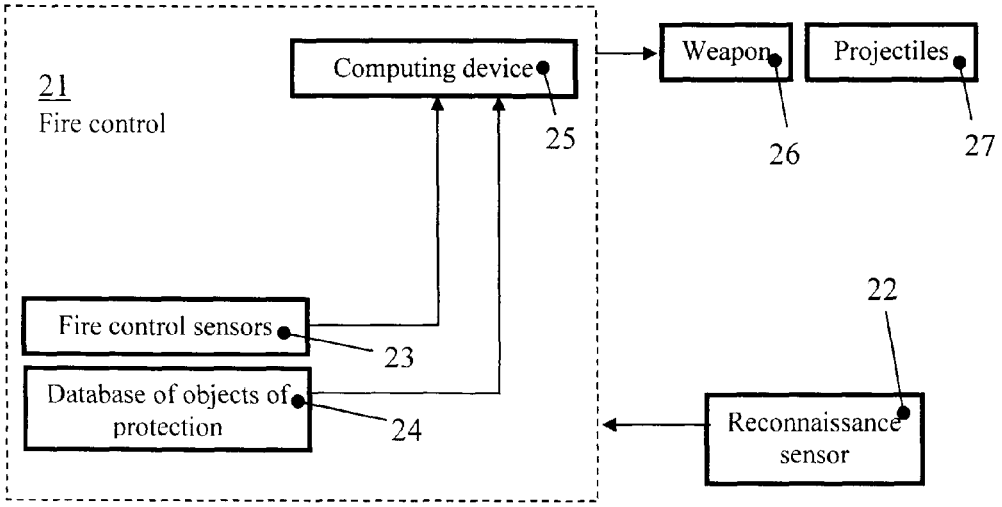
FIG. 2 shows a block diagram of the device for fighting aerial targets according to an embodiment of the invention.

A gun-based anti-aircraft defence system 20, shown in FIG. 2, comprises a fire control 21, one or several weapons 26 and projectiles 27 that can be fired against aerial targets. The system 20 receives target assignment from an external reconnaissance sensor 22, which can scan very large volumes of great depths at the expense of accuracy and sampling frequency. The gun-based anti-aircraft defence system 20 includes a fire control sensor 23 which, after target assignment, can estimate the position of the individual aerial target in a small sector of limited depth but with high accuracy and high sampling frequency. The computing device 25 is used to compute the points of aim towards which to direct the weapons 26. The fire control 21 can also comprise a database of objects of protection 24 containing the positions of a plurality of objects of protection which may be located in the immediate vicinity of the gun-based anti-aircraft defence system 20.

Figure 3:
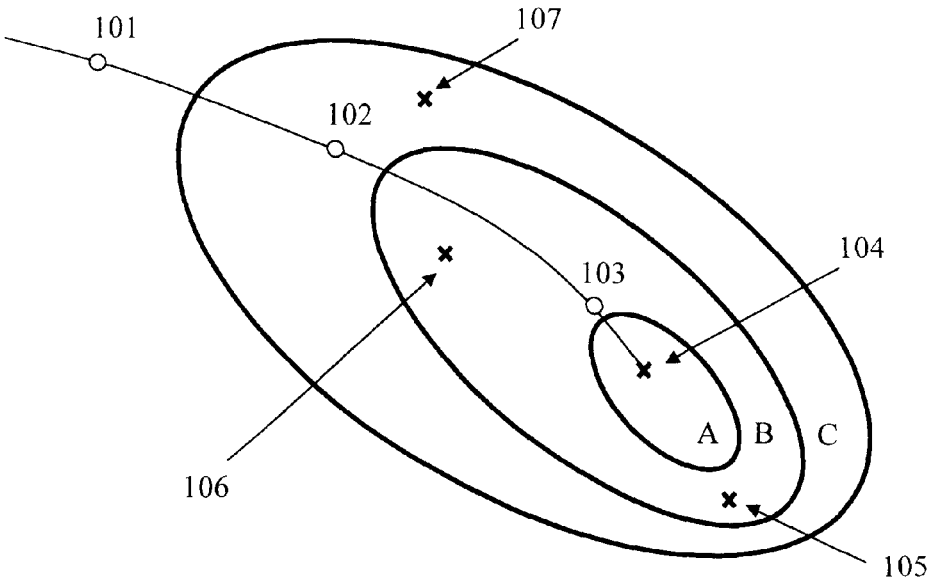
FIG. 3 shows target areas for an aerial target according to an embodiment of the invention.

FIG. 3 shows a target area 100 of an aerial target heading towards one of several objects of protection. When the aerial target travels towards the object of protection 104 a number of objects of protection 105, 106, 107 will be passed or fall outside the area to which the aerial target can manoeuvre. In point 101 the aerial target can be guided to all objects of protection 104, 105, 106, 107 within target area C. As the aerial target continues on its way towards the object of protection, after a certain time, the aerial target will be in point 102, where all objects of protection 104, 105, 106 within target area B can be attacked by the aerial target. Furthermore, the aerial target continues to point 103, target area A, where objects of protection 105 and 106 can no longer be attacked; hence only object of protection 104 can be attacked. Therefore, it is clear that the likely destination of the aerial target is object of protection 104. When the probable object of protection is now identified, points of aim can be calculated with greater reliability.

Figure 4:
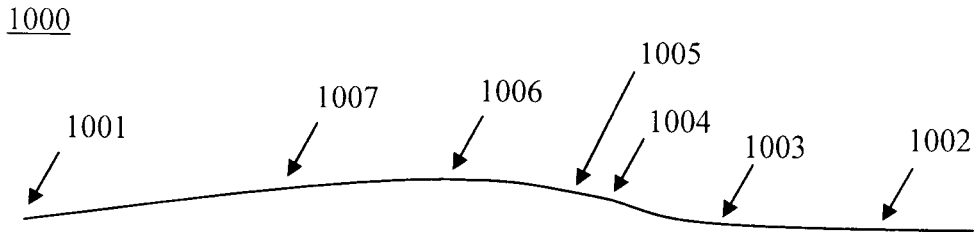
FIG. 4 shows the trajectory of an aerial target according to an embodiment of the invention.

FIG. 4 shows an aerial target's trajectory 1000 towards an object of protection 1001. The aerial target approaches the object of protection 1001. The aerial target is detected by a reconnaissance sensor as it passes point 1002. The reconnaissance sensor then assigns a fire control sensor. Somewhere between point 1002 and 1003, the fire control sensor finds the aerial target and starts tracking and estimating the position and velocity of the aerial target. At point 1003, the aerial target possibly starts a change of direction, for example, with the intention of discovering the object of protection 1001. At point 1004, the aerial target's change of course is completed. At point 1005, the aerial target begins to follow a guidance law striving to guide the craft to hitting the object of protection 1001. As the aerial target passes point 1006, fire control can start predicting the point of aim 1007. The prediction is based on data from the fire control sensor and a hypothesis about which guidance law is used by the aerial target.

Alternative Embodiments

The invention is not limited to the specific embodiments shown but can be varied in different ways within the scope of the claims.

For example, it will be appreciated that the number of sensors, the launching device, or systems of elements and details included in the method of fire control against manoeuvred aerial targets are adapted to the weapon system (s), the platform and other design characteristics that currently exist.

It will be appreciated that the above described method of fire control against manoeuvred aerial targets can be applied to virtually any guided craft and systems including aeroplanes, unmanned aircraft and missiles.

The invention claimed is:

1. A method of fire control against aerial targets on their way towards an object of protection, wherein a position of the object of protection is known, the method comprising:

measuring a position of the aerial target, estimating the position of the aerial target, estimating a velocity of the aerial target, applying a model of a guidance law of the aerial target, calculating an acceleration of the aerial target to hit the object of protection, predicting a future trajectory of the aerial target based on the position of the object of protection, the estimated position of the aerial target, the estimated velocity of the aerial target, and the calculated acceleration of the aerial target, and calculating points of aim along the predicted future trajectory.

2. The method of fire control against aerial targets according to claim 1, wherein the guidance law of the aerial target comprises navigation constants calculated by multiplying an observed acceleration by a predicted time to impact into the object of protection squared, divided by a distance from the aerial target to the object of protection.

3. The method of fire control against aerial targets according to claim 2, wherein the guidance law of the aerial target comprises a maximum acceleration, a size of which is estimated by an analysis of the observed acceleration of the aerial target.

4. The method of fire control against aerial targets according to claim 1, wherein the position of the object of protection is the position of a gun-based anti-aircraft defence.

5. A fire control system for fire control against aerial targets, the fire control system comprising:

at least one sensor for measuring a position of the aerial target as a function of time, a control module configured to measure a position of the aerial target, estimate the position of the aerial target, estimate a velocity of the aerial target, apply a model of a guidance law of the aerial target, calculate an acceleration of the aerial target to hit the object of protection, predict a future trajectory of the aerial target based on the position of the object of protection, the estimated position of the aerial target, the estimated velocity of the aerial target, and the calculated acceleration of the aerial target, and calculate points of aim along the predicted future trajectory.

* * * * *